US009295339B2

(12) United States Patent
Hampton

(10) Patent No.: US 9,295,339 B2
(45) Date of Patent: Mar. 29, 2016

(54) UPHOLSTERY CHAIR COVER

(71) Applicant: Catherine Edna Hampton, Indianapolis, IN (US)

(72) Inventor: Catherine Edna Hampton, Indianapolis, IN (US)

(73) Assignee: Catherine Hampton, Indianapolis, IN (US)

( * ) Notice: Subject to any disclaimer, the term of this patent is extended or adjusted under 35 U.S.C. 154(b) by 0 days.

(21) Appl. No.: 14/504,064

(22) Filed: Oct. 1, 2014

(65) Prior Publication Data

US 2015/0015038 A1 Jan. 15, 2015

Related U.S. Application Data

(63) Continuation-in-part of application No. 12/592,632, filed on Dec. 1, 2009, now abandoned.

(51) Int. Cl.
*A47C 31/11* (2006.01)
*A47C 3/02* (2006.01)
*A47C 31/02* (2006.01)

(52) U.S. Cl.
CPC ..... *A47C 31/11* (2013.01); *A47C 31/023* (2013.01)

(58) Field of Classification Search
CPC ..... A47C 31/11; A47C 31/02; A47C 31/113; A47C 31/023
USPC ..... 297/218.5, 900, 219.1, 228.13, 229, 297/DIG. 6, 218.1, 225, 228, 228.12, 218.3, 297/218.4
See application file for complete search history.

(56) References Cited

U.S. PATENT DOCUMENTS

| | | | | |
|---|---|---|---|---|
| 517,306 | A | 3/1894 | Seher | |
| 2,228,948 | A * | 1/1941 | Field | 297/229 |
| 2,820,510 | A | 1/1958 | Sugarman | |
| 4,323,610 | A * | 4/1982 | Leverich | 428/68 |
| D307,995 | S | 5/1990 | Kelldorf | |
| 5,007,676 | A | 4/1991 | Lien | |
| 5,476,308 | A * | 12/1995 | St. Germain | 297/440.11 |
| 5,624,157 | A * | 4/1997 | Kostuk | 297/228.13 |
| 5,709,431 | A * | 1/1998 | Horn | 297/228.1 |
| 6,079,778 | A * | 6/2000 | Lindberg | 297/223 |
| D444,982 | S | 7/2001 | LaConte | |

(Continued)

FOREIGN PATENT DOCUMENTS

| | | | |
|---|---|---|---|
| FR | 1464526 | * | 3/1967 |
| JP | 02001000262 | A | 1/2001 |
| JP | 5291259 | B1 * | 9/2013 |

*Primary Examiner* — Milton Nelson, Jr.
(74) *Attorney, Agent, or Firm* — Ice Miller LLP

(57) ABSTRACT

Upholstery chair covers and methods for upholstering a chair using the same are disclosed. In at least one embodiment, the upholstery chair cover includes a piece of material sized and shaped to cover a body of a chair, and includes a back portion, a seat portion connected to the back portion, at least one flap connected to the seat portion with at least one fastener, wherein the at least one flap secures the piece of material to the body of the chair. In another embodiment, the piece of material includes at least one leg flap connected to the seat portion with at least one leg fastener, wherein the at least one leg fastener secures the at least one leg flap to at least one leg of the chair. The upholstery chair cover may include cushions. The upholstery chair cover gives the appearance of a new re-upholstered chair.

17 Claims, 12 Drawing Sheets

(56) References Cited

U.S. PATENT DOCUMENTS

| | | | | |
|---|---|---|---|---|
| 6,354,661 | B1 * | 3/2002 | Moss | 297/229 |
| 6,409,264 | B1 | 6/2002 | Palmer et al. | |
| 6,634,709 | B1 | 10/2003 | Hetherington | |
| 6,647,589 | B1 * | 11/2003 | Youngwith | 16/18 CG |
| D575,976 | S | 9/2008 | Miller | |
| 7,469,962 | B2 | 12/2008 | Paulin | |
| 2004/0075315 | A1 * | 4/2004 | Patrick | 297/219.1 |
| 2007/0145798 | A1 | 6/2007 | Nadler-Sachs | |

* cited by examiner

UPHOLSTERY CHAIR COVER

PRIORITY

This U.S. Utility Patent Application is a continuation-in part application of, and claims priority to, U.S. patent application Ser. No. 12/592,632, filed Dec. 1, 2009 and now abandoned, contents of which are hereby incorporated by reference in its entirety into this disclosure.

BACKGROUND

Chair covers are placed over many different types of chairs in order to protect the chair underneath or to change the style and/or color of the chair. Chair covers are widely used on chairs within the home, outside, and at venues for events. Most short straight skirt, long pleated skirt, and long straight chair covers are supposed to give a chair an updated new look, but most chair covers are obvious and old-fashioned because the legs are not covered or the long straight or pleated skirt that ties in the back is visible. Current chair covers make the chair look as if someone has simply thrown a piece of material over it and do not give an appearance of a reupholstered chair. Therefore, chair covers and methods of upholstering a chair with a chair cover are needed that allow a chair cover to fit easily on almost any type of chair and give the appearance of a newly reupholstered, contemporary, fashionable, and natural chair.

BRIEF SUMMARY

The disclosed upholstery chair covers and methods for upholstering a chair using the same are designed to fit easily on almost any type of chair and will give the chair a more contemporary, natural, and fashionable appearance. This chair cover will also make the chair look as if it had been completely re-upholstered.

In at least one embodiment of the present disclosure, an upholstery chair cover is provided. The upholstery chair cover includes a first piece of material sized and shaped to cover a body of a chair, and includes a back portion, a seat portion connected to the back portion, and at least one flap connected to the seat portion with at least one fastener, wherein the at least one flap secures the piece of material to the body of the chair via the at least one fastener. In at least one exemplary embodiment, the first piece of material has a first flap with at least one first fastener, a second flap with at least one second fastener, a third flap with at least one third fastener, and a fourth flap with at least one fourth fastener. In yet another at least one exemplary embodiment, the first flap operably connects to the second flap via the at least one first fastener, the second flap operably connects to the first flap and the third flap via the at least one second fastener, the third flap operably connects to the second flap and the fourth flap via the at least one third fastener, and the fourth flap operably connects to the third flap via the at least one fourth fastener to secure the first piece of material to the body of the chair.

In at least one embodiment, the first piece of material includes at least one leg flap connected to the seat portion with at least one leg fastener, wherein the at least one leg fastener secures the at least one leg flap to at least one leg of the chair. In yet another embodiment, the upholstery chair cover includes at least one second piece of material sized and shaped to cover at least one leg of a chair, wherein the at least one second piece of material includes at least one leg fastener, and wherein the at least one leg fastener secures the at least one second piece of material to the at least one leg of the chair.

In another at least one exemplary embodiment, the at least one second piece of material is padded with a least one third piece of material.

In at least one exemplary embodiment, the at least one fastener is Velcro. In another at least one exemplary embodiment, the first piece of material is machine washable. In another at least one exemplary embodiment, the back portion comprises a removable cushion. In yet another at least one exemplary embodiment, the seat portion comprises a removable cushion. In at least one embodiment, the back portion comprises a first pocket made from a third piece of material and the seat portion comprises a second pocket made from a fourth piece of material. In at least one exemplary embodiment, the back portion includes a first cushion that is removably contained within the first pocket, and the seat portion includes a second cushion removably contained within the second pocket.

In another embodiment of the present disclosure, the upholstery chair cover includes a first piece of material sized and shaped to cover a body of a chair. The first piece of material includes a back portion containing a first removable cushion, a seat portion connected to the back portion containing a second removable cushion, a first flap connected to the seat portion with at least one first fastener, a second flap connected to the seat portion with at least one second fastener, a third flap connected to the seat portion with at least one third fastener, a fourth flap connected to the seat portion with at least one fourth fastener, and at least one leg flap connected to the seat portion with at least one leg fastener. The at least one leg fastener secures the at least one leg flap to at least one leg of the chair, and the first flap operably connects to the second flap via the at least one first fastener, the second flap operably connects to the first flap and the third flap via the at least one second fastener, the third flap operably connects to the second flap and the fourth flap via the at least one third fastener, and the fourth flap operably connects to the third flap via the at least one fourth fastener to secure the piece of material to the body of the chair.

The disclosed embodiments also include methods for upholstering a chair using a disclosed upholstery chair cover. In at least one embodiment of the present disclosure, the method includes the steps of selecting a chair to be upholstered, wherein the chair comprises a back, a seat, and at least one leg; selecting at least one first piece of material sized and shaped to cover the chair, wherein the at least one first piece of material includes: a back portion, a seat portion connected to the back portion, and at least one flap connected to the seat portion with at least one fastener; sliding the at least one first piece of material over the back of the chair; and securing the at least one first piece of material to the chair comprising the steps of: folding the at least one flap underneath the seat of the chair; and operatively connecting the at least one flap to the seat of the chair via the at least one fastener.

In an exemplary embodiment, the at least one flap connected to the seat portion with at least one fastener includes: a first flap connected to the seat portion with at least one first fastener, a second flap connected to the seat portion with at least one second fastener, a third flap connected to the seat portion with at least one third fastener, and a fourth flap connected to the seat portion with at least one fourth fastener; and wherein the step of securing the at least one first piece of material to the chair further includes the steps of: folding the first flap underneath the seat of the chair, folding the second flap underneath the seat of the chair and operably connecting the first flap to the second flap by fastening the at least one first fastener to the at least one second fastener, folding the third flap underneath the seat of the chair and operably connecting the third flap to the second flap by fastening the at least one second fastener to the at least one third fastener, and folding the fourth flap underneath the seat of the chair and operably connecting the fourth flap to the third flap by fastening the at least one third fastener to the at least one fourth fastener.

In at least one embodiment, the at least one first piece of material includes at least one leg flap connected to the seat portion with at least one leg fastener. In at least one embodiment, the step of securing the at least one first piece of material to the chair includes the step of folding the at least one leg flap around the at least one leg of the chair and fastening the at least one leg flap to itself via the at least one leg fastener. In at least one embodiment, the method includes the steps of selecting at least one second piece of material sized and shaped to cover the at least one leg of a chair, wherein the at least one second piece of material comprises at least one leg fastener, and securing the at least one second piece of material to the leg of the chair by folding the at least one second piece of material around the at least one leg of the chair and fastening the at least one second piece of material to itself via the at least one leg fastener.

In at least one exemplary embodiment, the at least one first piece of material comprises a first pocket and the seat portion of the at least one first piece of material comprises a second pocket, wherein the first pocket and the second pocket are made from at least one second piece of material. In yet another at least one exemplary embodiment, the method includes the steps of cutting a first cushion and a second cushion from at least one third piece of material, sliding a first cushion into the first pocket, and sliding a second cushion into the second pocket. Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION

Figure 1A:
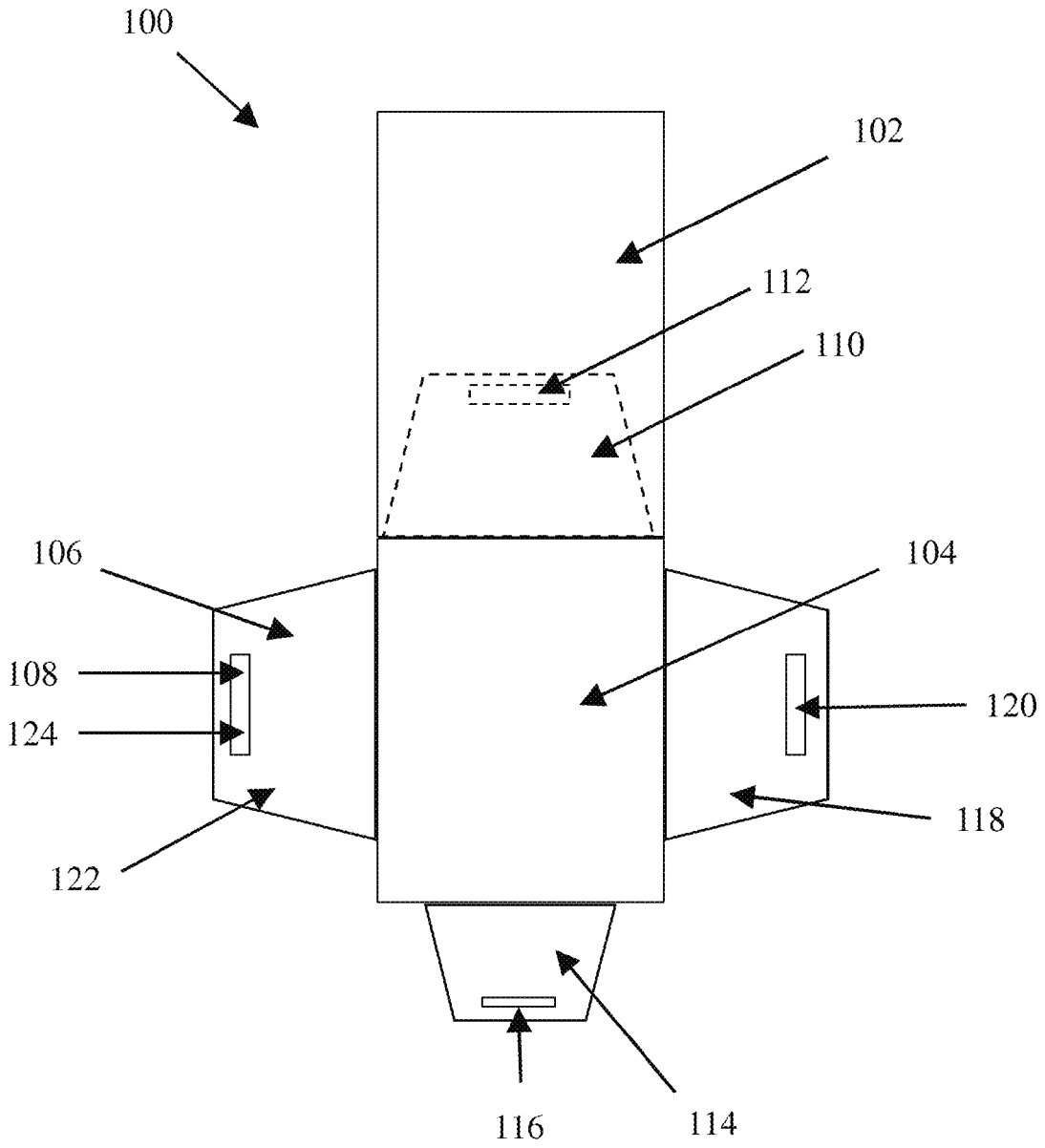
FIG. 1A is an illustration of a top view of an upholstery chair cover according to embodiments of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 1B:
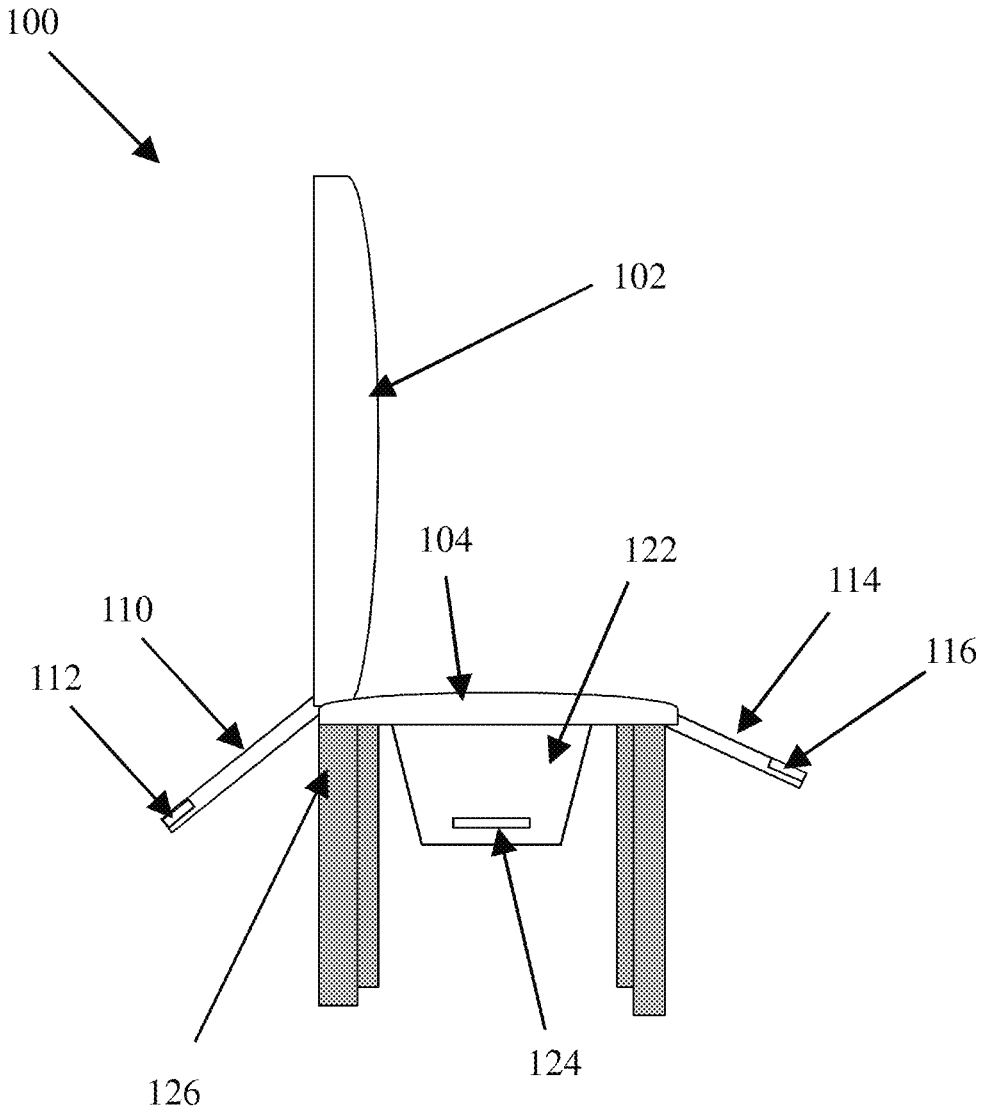
FIG. 1B is an illustration of a side view of an upholstery chair cover according to embodiments of the present disclosure.

An upholstery chair cover according to the present disclosure is designed to slide on and off easily from the top of the chair. An exemplary embodiment of an upholstery chair cover of the present disclosure is shown in FIGS. 1A and 1B. FIGS. 1A and 1B show that the upholstery chair cover includes at least one first piece of material 100 sized and shaped to cover a body of a chair 126, and includes a back portion 102, a seat portion 104 connected to the back portion 102, and at least one flap 106 connected to the seat portion 104 with at least one fastener 108, wherein the at least one flap 106 secures the at least one first piece of material 100 to the body of a chair 126. In embodiments of the present disclosure, the seat portion 104 of the at least one first piece of material 100 has a back flap 110 with at least one first fastener 112, a front flap 114 with at least one second fastener 116, a left flap 118 with at least one third fastener 120, and a right flap 122 with at least one fourth fastener 124.

The types of chairs that may be upholstered using the upholstery chair cover of the present disclosure contain a back, a seat, and at least one leg, and include, but are not limited to, dining chairs, kitchen chairs, desk chairs, folding chairs, bar stools, armchairs, benches, and lounge chairs. The types of fabric that may be used for the at least one first piece of material 100 may consist of any color, design, or fiber and may include, but are not limited to, woven, non-woven, knitted, netted, and technical fabrics, such as cotton, linen, silk, leather, polyester, acrylic, olefin, rayon, viscose, and nylon. In at least one exemplary embodiment, the at least one first piece of material 100 is made from a material that is machine washable. The at least one fastener 108 may include, but is not limited to, a hook a loop fastener, button, clasp, Velcro®, tie, buckle, clip, flange, hook-and-eye closure, stitch, strap, staple, pin, and zipper. In an exemplary embodiment, the at least one fastener 108 is Velcro®.

Figure 2A:
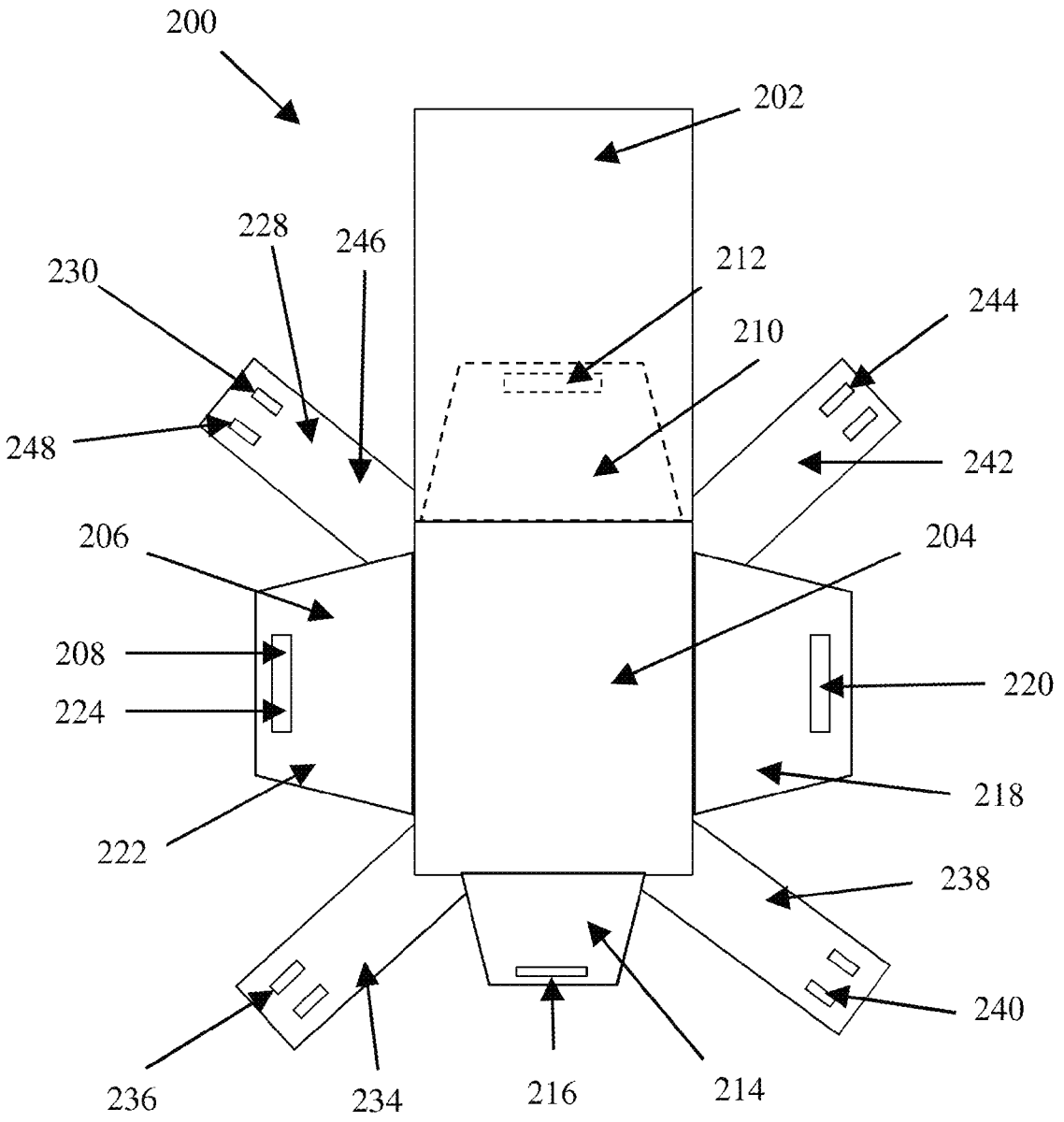
FIG. 2A is an illustration of a top view of an upholstery chair cover according to embodiments of the present disclosure.
Figure 2B:
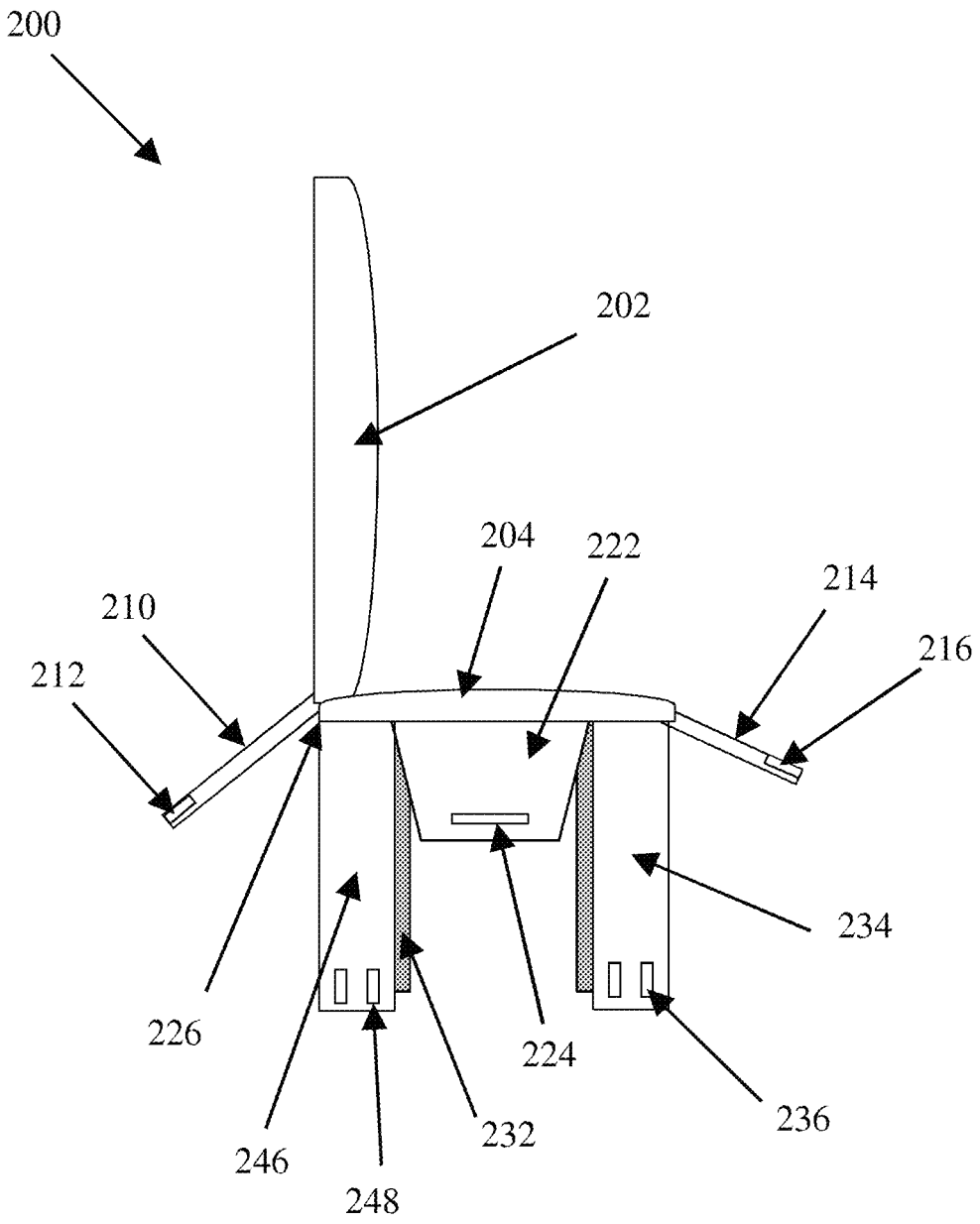
FIG. 2B is an illustration of a side view of an upholstery chair cover according to embodiments of the present disclosure.

As shown in FIGS. 2A and 2B, another embodiment of the upholstery chair cover includes at least one first piece of material 200 sized and shaped to cover a body of a chair 226, wherein the at least one first piece of material 200 includes: a back portion 202; a seat portion 204 connected to the back portion 202; at least one flap 206 connected to the seat portion 204 with at least one fastener 208, wherein the at least one flap 206 secures the at least one first piece of material 200 to the body of a chair 226; and at least one leg flap 228 connected to the seat portion 204 with at least one leg fastener 230, wherein the at least one leg fastener 230 secures the at least one leg flap 228 to at least one leg of a chair 232. In an exemplary embodiment, the at least one leg flap 228 comprises a front right leg flap 234 with a front right leg fastener 236, a front left leg flap 238 with a front left leg fastener 240, a back left leg flap 242 with a back left leg fastener 244, and a back right leg flap 246 with a back right leg fastener 248. The at least one leg fastener 230 may include, but is not limited to, a hook a loop fastener, button, clasp, Velcro®, tie, buckle, clip, flange, hook-and-eye closure, stitch, strap, staple, pin, and zipper. In an exemplary embodiment, the at least one leg fastener 230 is Velcro®.

Figure 3:
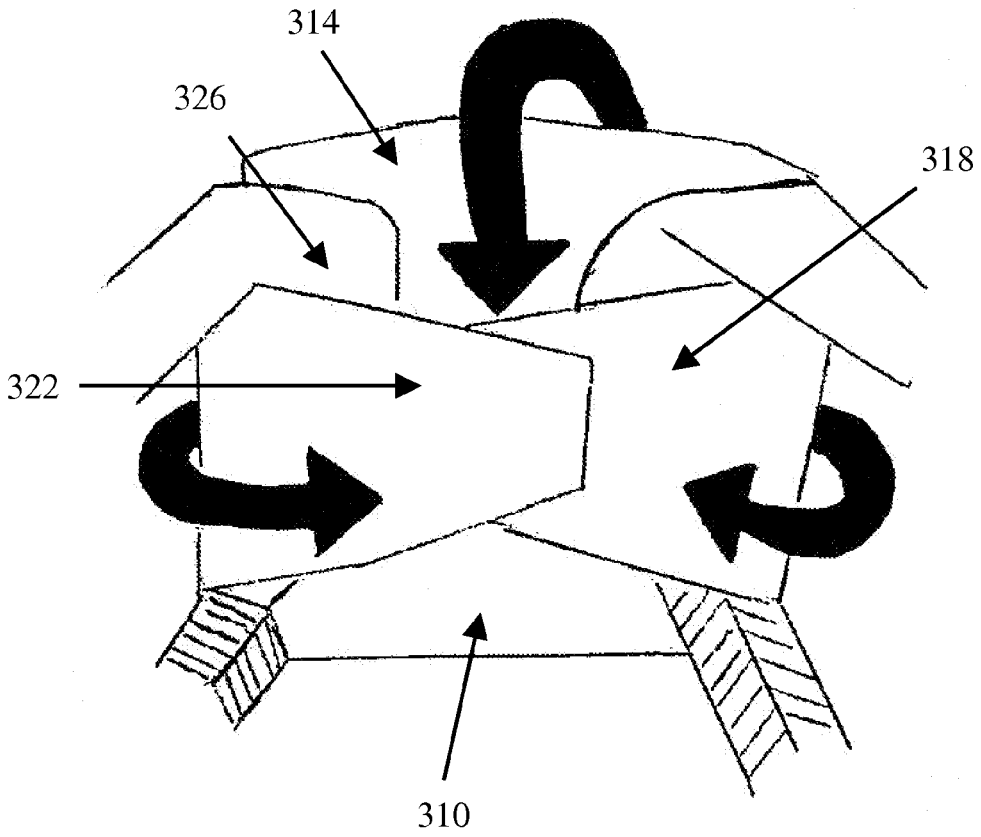
FIG. 3 is an illustration of a bottom view of a chair for a method for upholstering a chair with an upholstery chair cover according to embodiments of the present disclosure.

FIG. 3. shows an exemplary embodiment of the upholstery chair cover of the present disclosure. In FIG. 3, a first flap 310 connected to the seat portion operably connects to a second flap 314 connected to the seat portion via at least one first fastener, the second flap 314 operably connects to the first flap 310 and a third flap 318 connected to the seat portion via at least one second fastener, the third flap 318 operably connects to the second flap 314 and a fourth flap 322 connected to the seat portion via the at least one third fastener, and the fourth flap 322 operably connects to the third flap 318 via the at least one fourth fastener to secure the at least one first piece of material to the body of a chair 326.

Figure 4:
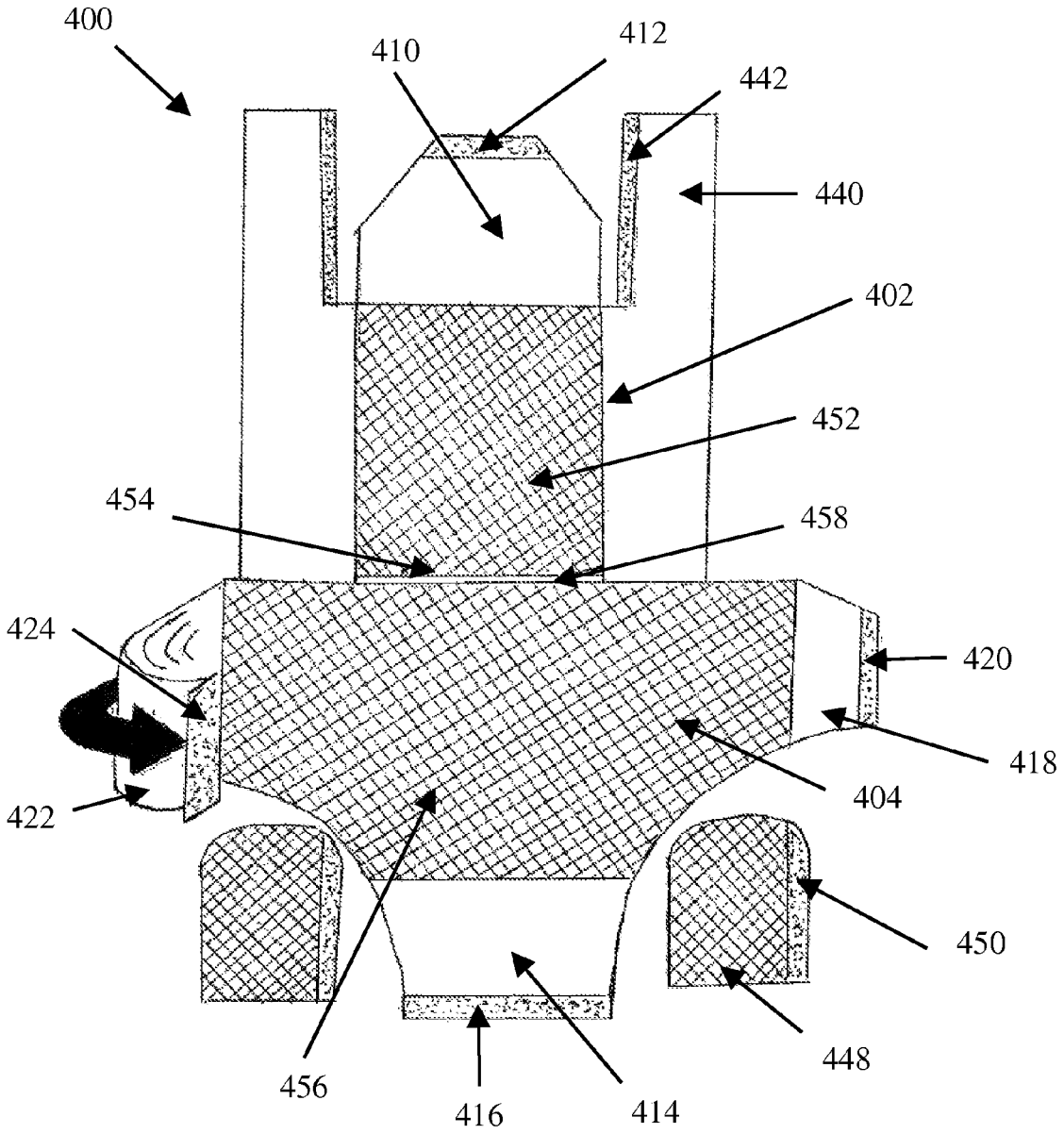
FIG. 4 is an illustration of a top view of an upholstery chair cover according to embodiments of the present disclosure.

Another exemplary embodiment of the upholstery chair cover of the present disclosure is shown in FIG. 4. As shown in FIG. 4, the upholstery chair cover includes at least one first piece of material 400 sized and shaped to cover a body of a chair. In at least one embodiment, the first piece of material 400 includes a back portion 402, a seat portion 404 connected to the back portion 402, a back flap 410 connected to the seat portion 404 with at least one first fastener 412, a front flap 414 connected to the seat portion 404 with at least one second fastener 416, a left flap 418 connected to the seat portion 404 with at least one third fastener 420, a right flap 422 connected to the seat portion 404 with at least one fourth fastener 424, and at least one leg flap 440 connected to the seat portion 404 with at least one first leg fastener 442. In another at least one embodiment, the at least one leg fastener 442 secures the at least one leg flap 440 to at least one leg of the chair. In yet another at least one embodiment, the back flap 410 operably connects to the front flap 414 via the at least one first fastener 412, the front flap 414 operably connects to the back flap 410 and the left flap 418 via the at least one second fastener 416, the left 418 flap operably connects to the front flap 414 and the right flap 422 via the at least one third fastener 420, and the right flap 422 operably connects to the left flap 418 via the at least one fourth fastener 424 to secure the at least one first piece of material 400 to the body of a chair.

As shown in FIG. 4, one embodiment of the upholstery chair cover includes at least one second piece of material 448 sized and shaped to cover at least one leg of a chair, wherein the at least one second piece of material 448 includes at least one second leg fastener 450, and wherein the at least one second leg fastener 450 secures the at least one second piece of material 448 to at least one leg of a chair. In at least one embodiment as shown in FIG. 4, the upholstery chair cover includes at least one third piece of material 452 sized and shaped to cover the back portion 402 of the at least one first piece of material 400, wherein the at least one third piece of material 452 forms a first pocket 454. In another embodiment as shown in FIG. 4, the upholstery chair cover includes at least one fourth piece of material 456 sized and shaped to cover the seat portion 404 of the at least one first piece of material 400, wherein the at least one fourth piece of material 456 forms a second pocket 458. The types of fabric that may be used for the at least one third piece of material 452 and the at least one fourth piece of material 456 may consist of any color, design, or fiber and may include, but are not limited to, woven, non-woven, knitted, netted, and technical fabrics, such as cotton, linen, silk, leather, polyester, acrylic, olefin, rayon, viscose, and nylon. In one exemplary embodiment, the at least one third piece of material 452 is made of linen. In another exemplary embodiment, the at least one fourth piece of material 456 is made of linen.

Figure 5:
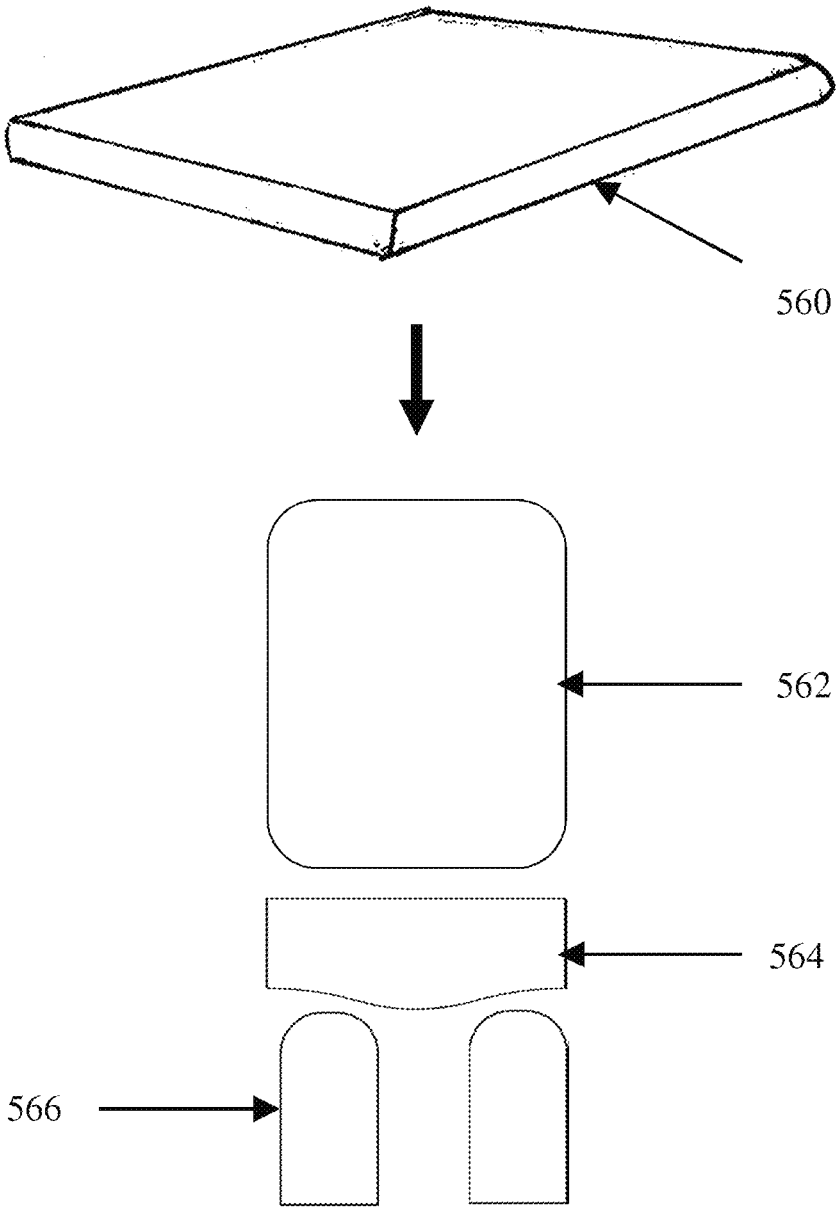
FIG. 5 is an illustration of a method for cutting up padding for an upholstery chair cover according to embodiments of the present disclosure.

At least one exemplary embodiment of the upholstery chair cover of the present disclosure includes cushions that slide into pockets on the inside of the material. The cushions may be placed within the back rest or seat portion of the chair cover permanently or they may be removable to add extra comfort and fullness. FIG. 5 shows how a piece of cushion material 560 may be cut up to be inserted or placed into at least one embodiment of the upholstery chair cover as disclosed in FIG. 4. In at least one exemplary embodiment, the back portion 402 includes a back cushion 562 that is contained within the first pocket 454, and the seat portion 404 includes a seat cushion 564 that is contained within the second pocket 458. In at least one exemplary embodiment, the back cushion 562 and/or the seat cushion 564 are removable.

In yet another at least one exemplary embodiment, the at least one second piece of material 448 is padded with at least one leg cushion 566 to create fullness and comfort. The back cushion 562, seat cushion 564, and leg cushion 566 may be made of any type of cushion or padding material with any type of density, including, but not limited to, latex pads, memory foam, cotton stuffing, down cushions, 100% premium urethane foam, and polyurethane foam. In an exemplary embodiment of the present disclosure, the back cushion 562 and/or the seat cushion 564 are made of 100% premium urethane foam. In yet another exemplary embodiment of the present disclosure, the leg cushion 566 is made of cotton stuffing.

Figure 6A:
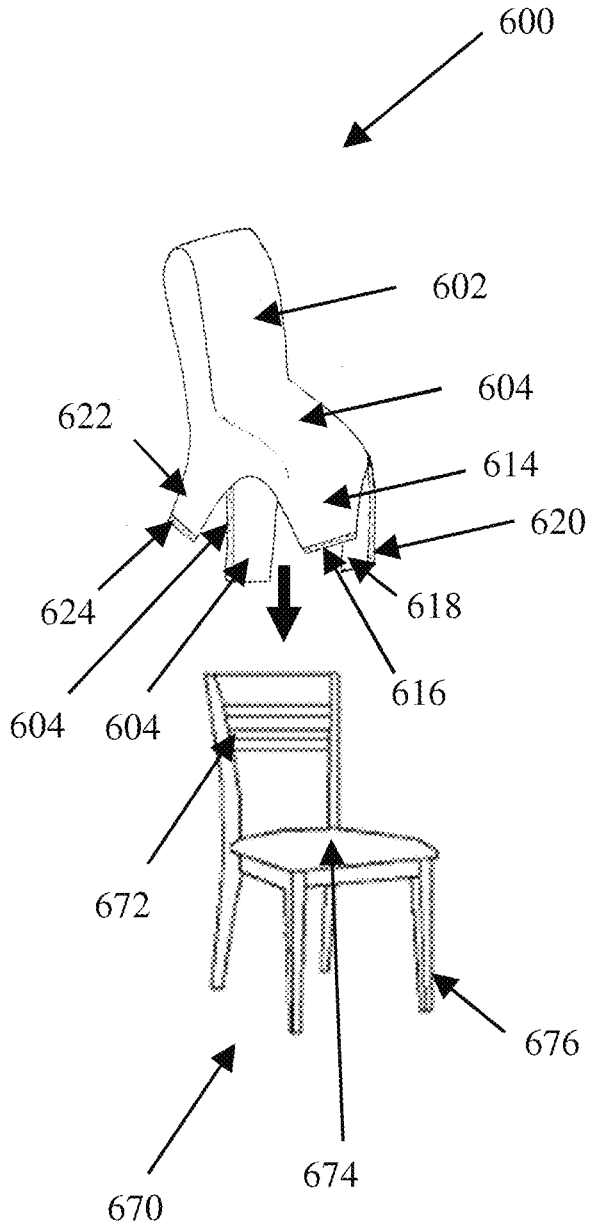
FIG. 6A is an illustration of a perspective view of a chair for a method for upholstering a chair with an upholstery chair cover according to embodiments of the present disclosure.
Figure 6B:
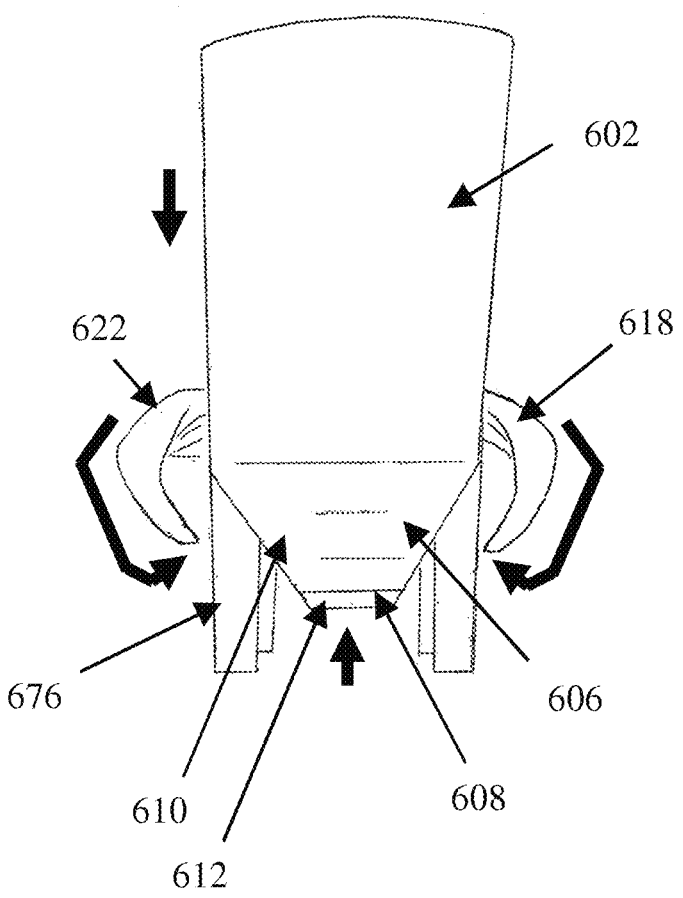
FIG. 6B is an illustration of a back view of a chair for a method for upholstering a chair with an upholstery chair cover according to embodiments of the present disclosure.
Figure 6C:
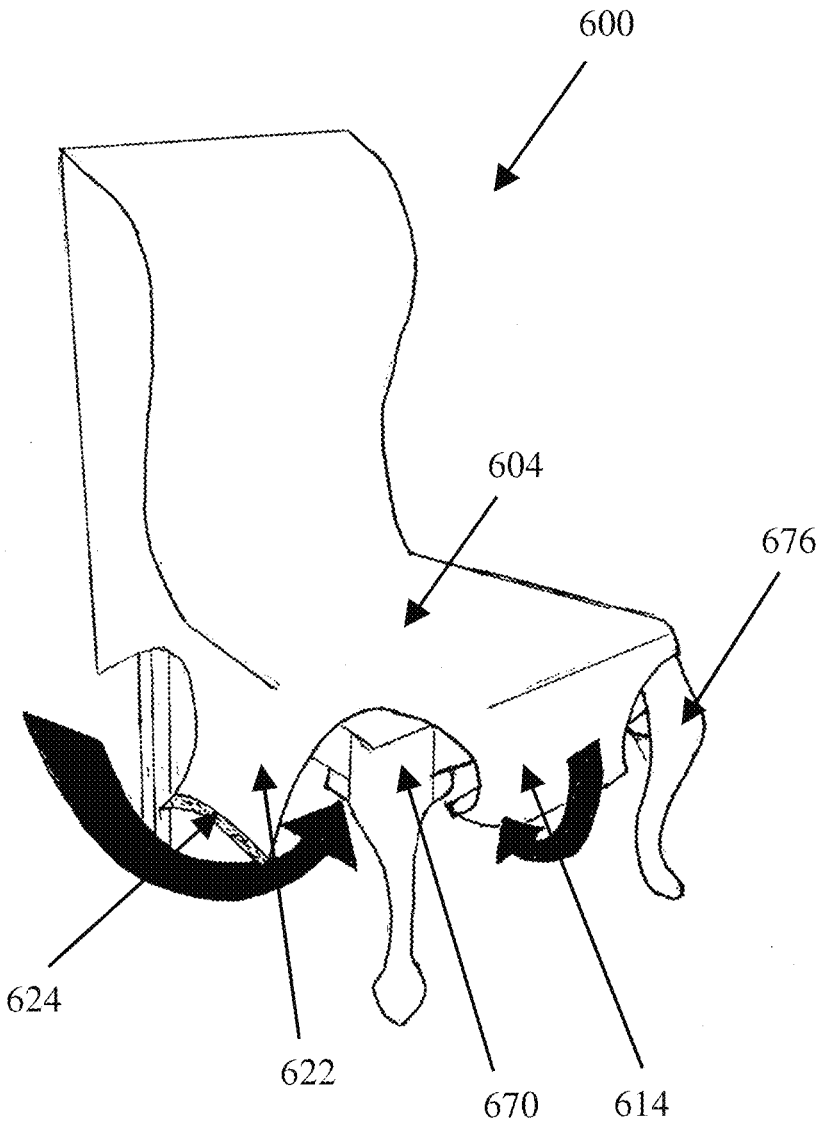
FIG. 6C is an illustration of a perspective view of a chair for a method for upholstering a chair with an upholstery chair cover according to embodiments of the present disclosure.

FIGS. 6A-C shows a method for upholstering a chair using the upholstery chair cover of the present disclosure. In at least one embodiment of the method of the present disclosure, the method includes the steps of: 1) selecting a chair 670 to be upholstered, wherein the chair 670 comprises a back 672, a seat 674, and at least one leg 676; 2) selecting at least one first piece of material 600 sized and shaped to cover the chair 670, wherein the at least one first piece of material 600 includes: a back portion 602, a seat portion 604 connected to the back portion 602, and at least one flap 606 connected to the seat portion 604 with at least one fastener 608; 3) sliding the at least one first piece of material 600 over the back 672 of the chair 670; and 4) securing the at least one first piece of material 600 to the chair 670 via the at least one flap 606 with the at least one fastener 608. In an exemplary embodiment, at least one flap 606 connected to the seat portion 604 with at least one fastener 608 comprises: a first flap 610 connected to the seat portion 604 with at least one first fastener 612; a second flap 614 connected to the seat portion 604 with at least one second fastener 616; a third flap 618 connected to the seat portion 604 with at least one third fastener 620; and a fourth flap 622 connected to the seat portion 604 with at least one fourth fastener 624.

In yet another exemplary embodiment of the method and as shown in FIGS. 3 and 6A-D, the step of securing the at least one first piece of material 600 to the chair 670 comprises the steps of: a) folding the first flap 610 (310) underneath the seat 674 of the chair 670, b) folding the second flap 614 (314) underneath the seat 674 of the chair 670 and operably connecting the first flap 610 (310) to the second flap 614 (314) by fastening the at least one first fastener 612 to the at least one second fastener 616, c) folding the third flap 618 (318) underneath the seat 674 of the chair 670 and operably connecting the third flap 618 (318) to the second flap 614 (314) by fastening the at least one second fastener 616 to the at least one third fastener 620, and d) folding the fourth flap 622 (322)

underneath the seat 674 of the chair 670 and operably connecting the fourth flap 622 (322) to the third flap 618 (318) by fastening the at least one third fastener 620 to the at least one fourth fastener 624.

Figure 6D:
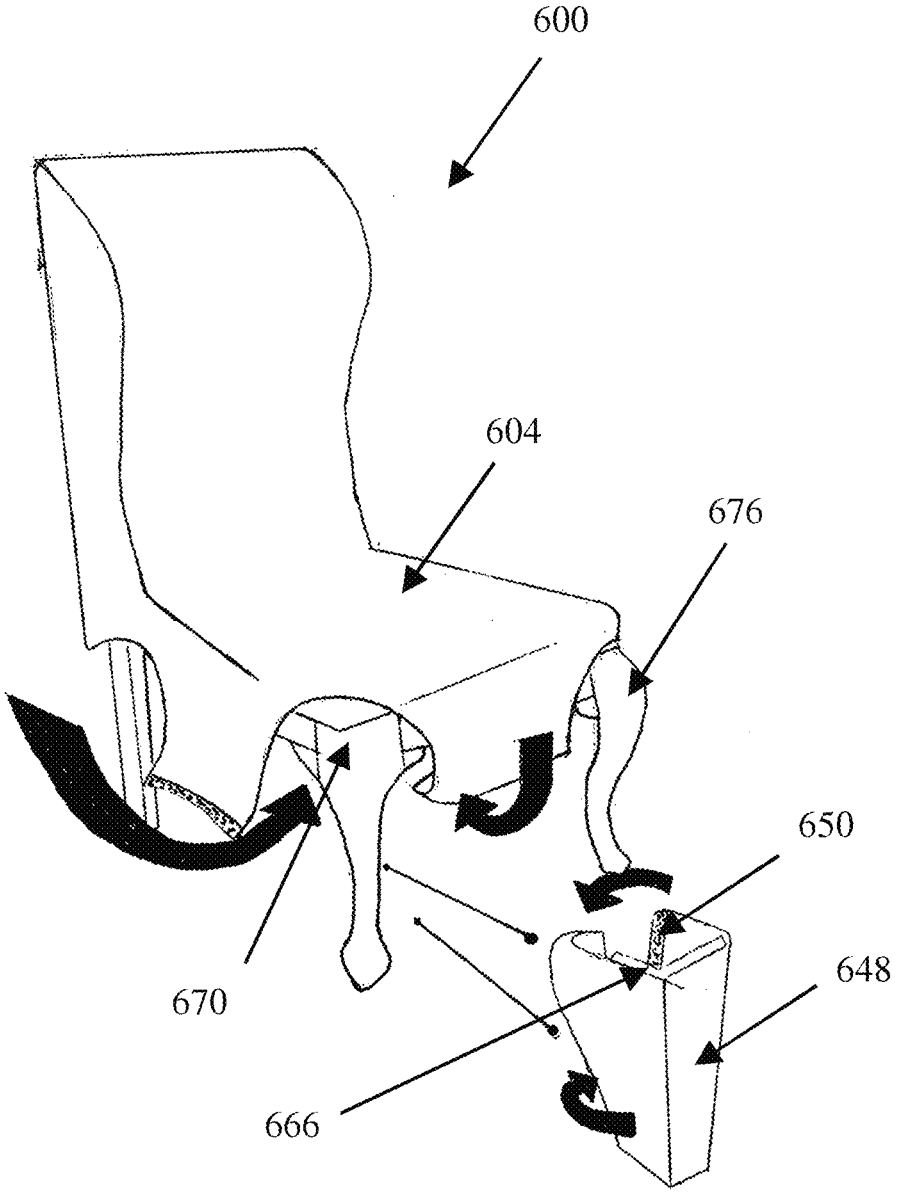
FIG. 6D is an illustration of a perspective view of a chair for a method for upholstering a chair with an upholstery chair cover according to embodiments of the present disclosure.

In at least one embodiment of the method of the present disclosure, the at least one first piece of material includes at least one leg flap connected to the seat portion with at least one leg fastener. In at least one embodiment of the method, the step of securing the at least one first piece of material to the chair includes the step of folding the at least one leg flap around the at least one leg of the chair and fastening the at least one leg flap to itself via the at least one leg fastener. In at least one exemplary embodiment as shown in FIG. 6D, the method includes the steps of selecting at least one second piece of material 648 sized and shaped to cover at least one leg 676 of a chair 670, wherein the at least one second piece of material 648 includes at least one leg fastener 650, and wherein the at least one leg fastener 650 secures the at least one second piece of material 648 to at least one leg 676 of a chair 670. In at least one embodiment, the step of securing the at least one second piece of material 648 to the leg 676 of the chair 670 includes the step of folding the at least one second piece of material 648 around the at least one leg 676 of the chair 670 and fastening the at least one second piece of material 648 to itself via the at least one leg fastener 650.

In at least one embodiment of the method of the present disclosure, the upholstery chair cover includes at least one third piece of material sized and shaped to cover the back portion of the at least one first piece of material. In at least one embodiment, the method includes the step of forming a first pocket out of the third piece of material by attaching the third piece of material to the back portion. In another embodiment, the upholstery chair cover includes at least one fourth piece of material sized and shaped to cover the seat portion of the at least one first piece of material. In at least one embodiment, the method includes the step of forming a second pocket out of the forth piece of material by attaching the fourth piece of material to the seat portion. The types of fabric that may be used for the at least one third piece of material and the at least one fourth piece of material may consist of any color, design, or fiber and may include, but are not limited to, woven, non-woven, knitted, netted, and technical fabrics, such as cotton, linen, silk, leather, polyester, acrylic, olefin, rayon, viscose, and nylon. In one exemplary embodiment, the at least one third piece of material is made of linen. In another exemplary embodiment, the at least one fourth piece of material is made of linen.

In at least one exemplary embodiment of the method of the present disclosure includes the steps of cutting up cushions from a fifth piece of material (see FIG. 5) and sliding the cushions into either the first pocket of the back side of the first piece of material and/or the second pocket of the seat portion of the first piece of material. In yet another at least one exemplary embodiment of the method as shown in FIG. 6D, the method includes the step of padding the at least one second piece of material 648 with at least one leg cushion 666. The back cushion, seat cushion, and leg cushion may be made of any type of cushion or padding material with any type of density, including, but not limited to, latex pads, memory foam, cotton stuffing, down cushions, 100% premium urethane foam, and polyurethane foam. In an exemplary embodiment of the present disclosure, the back cushion and/or the seat cushion are made of 100% premium urethane foam. In yet another exemplary embodiment of the present disclosure, the leg cushion is made of cotton stuffing.

Figure 7A:
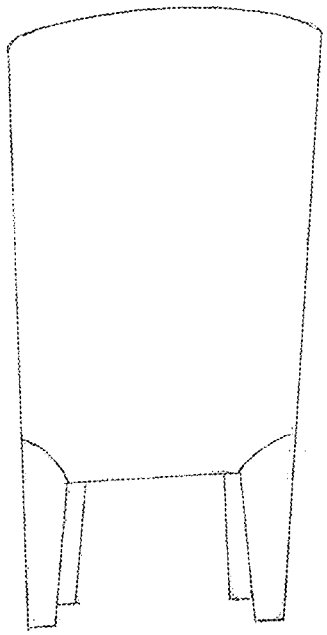
FIG. 7A is an illustration of a back view of a chair upholstered with an upholstery chair cover according to embodiments of the present disclosure.
Figure 7B:
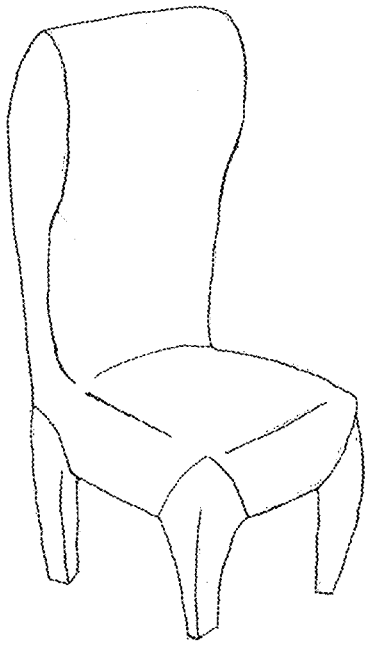
FIG. 7B is an illustration of a perspective view of a chair upholstered with an upholstery chair cover according to embodiments of the present disclosure.

Finally, FIGS. 7A and 7B show a chair covered with an embodiment of an upholstery chair cover as described in the present disclosure. The chair cover gives the appearance that the chair has been newly re-upholstered.

EXAMPLE 1

Method of Making an Upholstery Chair Cover

For manufacturing an upholstery chair cover of the present disclosure, fabric is selected, measured, cut, and sewn according to the following steps:

Step 1: Select a fabric for making the upholstery chair cover. Measure and cut the fabric to 103×60 inches. Measure and cut the top half of the fabric to 63×24 inches, the seat and sides to 60×14½ inches, the right, left, and front flaps to 16½ inches, and the back flap to 13 inches.

Step 2: Measure and cut the front legs from the remaining fabric to 20×10.25 inches.

Step 3: Select a linen fabric for making interior linen pockets. Measure and cut out linen for the backrest to 17½×50 inches, the seat to 24×34½ inches, and the legs to 10½×20 inches.

Step 4: Select foam or padding for making cushions measuring 24×96×1 inches. Measure and cut foam or patting for the backrest to 15×49 inches, the seat to 32½×23½ inches. Select and cut cotton stuffing measuring 10×20 inches for each of the front legs of the chair cover.

Step 5: Select and cut Velcro® strips for flaps. For the back right and left leg, cut to 13½ inches; for the right, left and front seat flaps, cut to 7 inches, and for the front right and left legs cut to 7 inches.

Step 6: Sew the two pieces of white linen pockets on the back of the fabric for the seat. The top of linen in the seat is left left open, and bottom of linen in the backrest is left open.

Step 7: Fold the fabric for the front legs (side and bottom) a ½ inch, and sew the on cotton stuffing and linen legs pieces.

Step 8: Add Velcro® strips by sewing onto the front left and right leg flap.

Step 9: Fold and hem of the back legs ½ inch and sew on Velcro®. Fold and hem seat flaps into a triangular shape and sew on Velcro®. Cut away any excess material.

Step 10: Sew the front leg flaps onto chair cover.

Step 11: Fold top part of chair cover and sew the right sides together, and then sew the left side of the cover together.

Step 12: Insert the foam cushion measuring 23½×32½ inches into the seat pocket, and insert the foam cushion measuring 49×15 inches into the backrest pocket.

While various embodiments of upholstery chair covers and methods for upholstering a chair using the same have been described in considerable detail herein, the embodiments are merely offered by way of non-limiting examples of the disclosure described herein. It will therefore be understood that various changes and modifications may be made, and equivalents may be substituted for elements thereof, without departing from the scope of the disclosure. Indeed, this disclosure is not intended to be exhaustive or to limit the scope of the disclosure.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

I claim:

1. An upholstery chair cover, comprising:

at least one first piece of material sized and shaped to cover a body of a chair comprising:

a back portion containing a first cushion made from at least one second piece of material;

a seat portion connected to the back portion containing a second cushion made from the at least one second piece of material;

a first flap with at least one first fastener;

a second flap with at least one second fastener;

a third flap with at least one third fastener;

a fourth flap with at least one fourth fastener; and at least one leg flap with at least one leg fastener;

wherein the at least one leg fastener is operable to secure the at least one leg flap to at least one leg of the chair; and wherein the first flap operably connects to the second flap via the at least one first fastener, the second flap operably connects to the first flap and the third flap via the at least one second fastener, the third flap operably connects to the second flap and the fourth flap via the at least one third fastener, and the fourth flap operably connects to the third flap via the at least one fourth fastener to secure the at least one first piece of material to the body of the chair.

2. The upholstery chair cover of claim 1, wherein the at least one first piece of material is machine washable.

3. The upholstery chair cover of claim 1, wherein the at least one leg flap is padded with at least one leg cushion.

4. The upholstery chair cover of claim 1, wherein the first cushion and second cushion are selected from the group consisting of: latex pads, memory foam, cotton stuffing, down cushions, 100% premium urethane foam, and polyurethane foam.

5. The upholstery chair cover of claim 1, wherein the first cushion is removable.

6. The upholstery chair cover of claim 1, wherein the second cushion is removable.

7. The upholstery chair cover of claim 1, wherein the at least one first piece of material is selected from the group consisting of: cotton, linen, silk, leather, polyester, acrylic, olefin, rayon, viscose, and nylon.

8. The upholstery chair cover of claim 7, wherein the at least one first piece of material is linen.

9. The upholstery chair cover of claim 1, further comprising at least one third piece of material and at least one fourth piece of material, wherein the at least one third piece of material is connected to the back portion to form a first pocket and wherein the at least one fourth piece of material is connected to the seat portion to form a second pocket.

10. The upholstery chair cover of claim 9, wherein the first cushion is removably contained within the first pocket, and the second cushion is removably contained within the second pocket.

11. The upholstery chair cover of claim 1, wherein the at least one first, second, third, fourth, and leg fastener are selected from the group consisting of: a hook and loop fastener, button, clasp, tie, buckle, clip, flange, hook-and-eye closure, stitch, strap, staple, pin, and zipper.

12. The upholstery chair cover of claim 11, wherein the at least one first, second, third, fourth, and leg fastener is a hook and loop fastener.

13. A method of upholstering a chair with a chair cover, the method comprising the steps of:

selecting a chair to be upholstered, wherein the chair comprises a back, a seat, and at least one leg;

selecting at least one first piece of material sized and shaped to cover the chair, wherein the at least one first piece of material comprises:

a back portion containing a first cushion made from at least one second piece of material;

a seat portion connected to the back portion containing a second cushion made from the at least one second piece of material;

a first flap with at least one first fastener;

a second flap with at least one second fastener;

a third flap with at least one third fastener;

a fourth flap with at least one fourth fastener; and at least one leg flap with at least one leg fastener;

sliding the at least one first piece of material over the back of the chair; and securing the at least one first piece of material to the chair comprising the steps of:

folding the first flap underneath the seat of the chair;

folding the second flap underneath the seat of the chair and operably connecting the first flap to the second flap by fastening the at least one first fastener to the at least one second fastener;

folding the third flap underneath the seat of the chair and operably connecting the third flap to the second flap by fastening the at least one second fastener to the at least one third fastener; and folding the fourth flap underneath the seat of the chair and operably connecting the fourth flap to the third flap by fastening the at least one third fastener to the at least one fourth fastener.

14. The method of claim 13, wherein the step of securing the at least one first piece of material to the chair further comprises the step of folding the at least one leg flap around the at least one leg of the chair and fastening the at least one leg flap to itself via the at least one leg fastener.

15. The method of claim 13, further comprising the step of:

securing the at least one leg flap to the leg of the chair by folding the at least one leg flap around the at least one leg of the chair and fastening the at least one leg flap to itself via the at least one leg fastener.

16. The method of claim 13, wherein the back portion of the at least one first piece of material comprises a first pocket and the seat portion of the at least one first piece of material comprises a second pocket.

17. The method of claim 16, further comprising the steps of:

sliding the first cushion into the first pocket of the back portion of the at least one first piece of material; and sliding the second cushion into the second pocket of the seat portion of the at least one first piece of material.

* * * * *